United States Patent [19]

Atkinson

[11] Patent Number: 4,484,504

[45] Date of Patent: Nov. 27, 1984

[54] SAW CHAIN WITH ANTI-KICKBACK CUTTER LINK

[75] Inventor: Renwick S. Atkinson, Portland, Oreg.

[73] Assignee: Carlton Company, Milwaukie, Oreg.

[21] Appl. No.: 314,583

[22] Filed: Dec. 30, 1981

[51] Int. Cl.[3] ..... B27B 33/14

[52] U.S. Cl. ..... 83/833; 83/834

[58] Field of Search ..... 83/833, 834, 830, 831, 83/832

[56] References Cited

U.S. PATENT DOCUMENTS 2,771,919 11/1956 Cox ..... 83/834

*Primary Examiner*—Donald R. Schran

*Attorney, Agent, or Firm*—Kolisch, Hartwell Dickinson & Anderson

[57] ABSTRACT

An anti-kickback saw chain including a cutter link having a cutter portion which includes a shoulder located rearwardly of a cutting edge at the forward end of the cutter portion.

3 Claims, 6 Drawing Figures

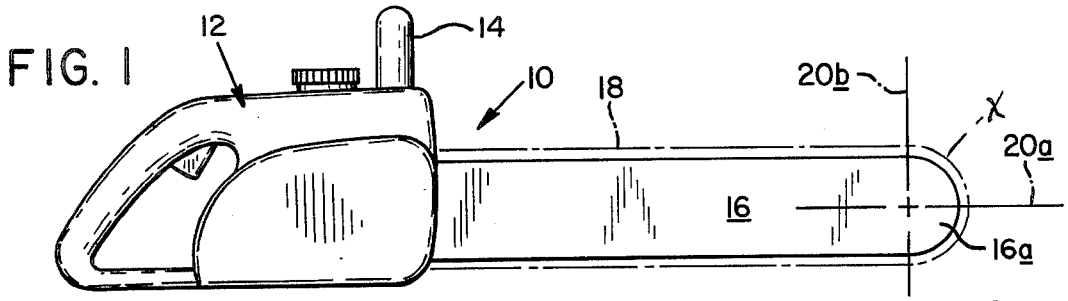
FIG. 1
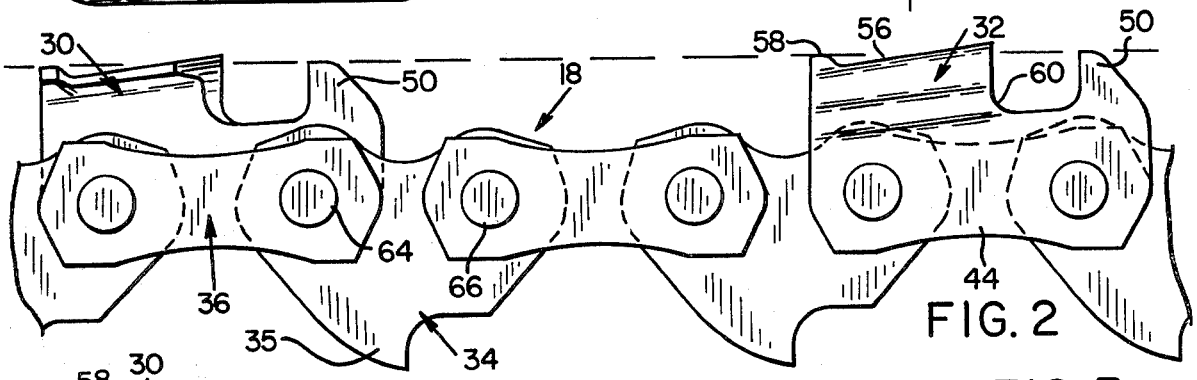
FIG. 2
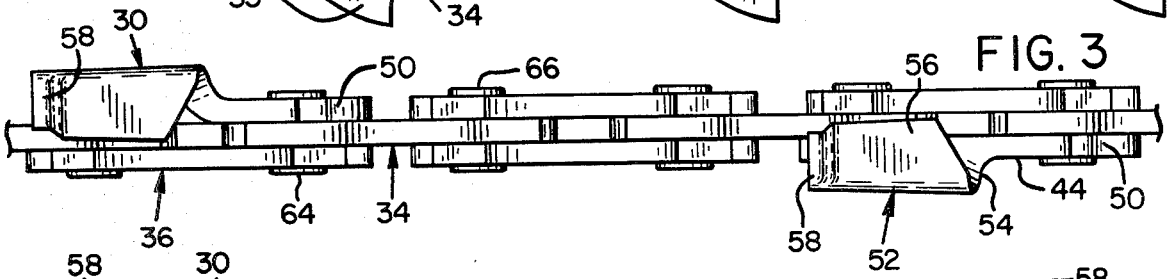
FIG. 3
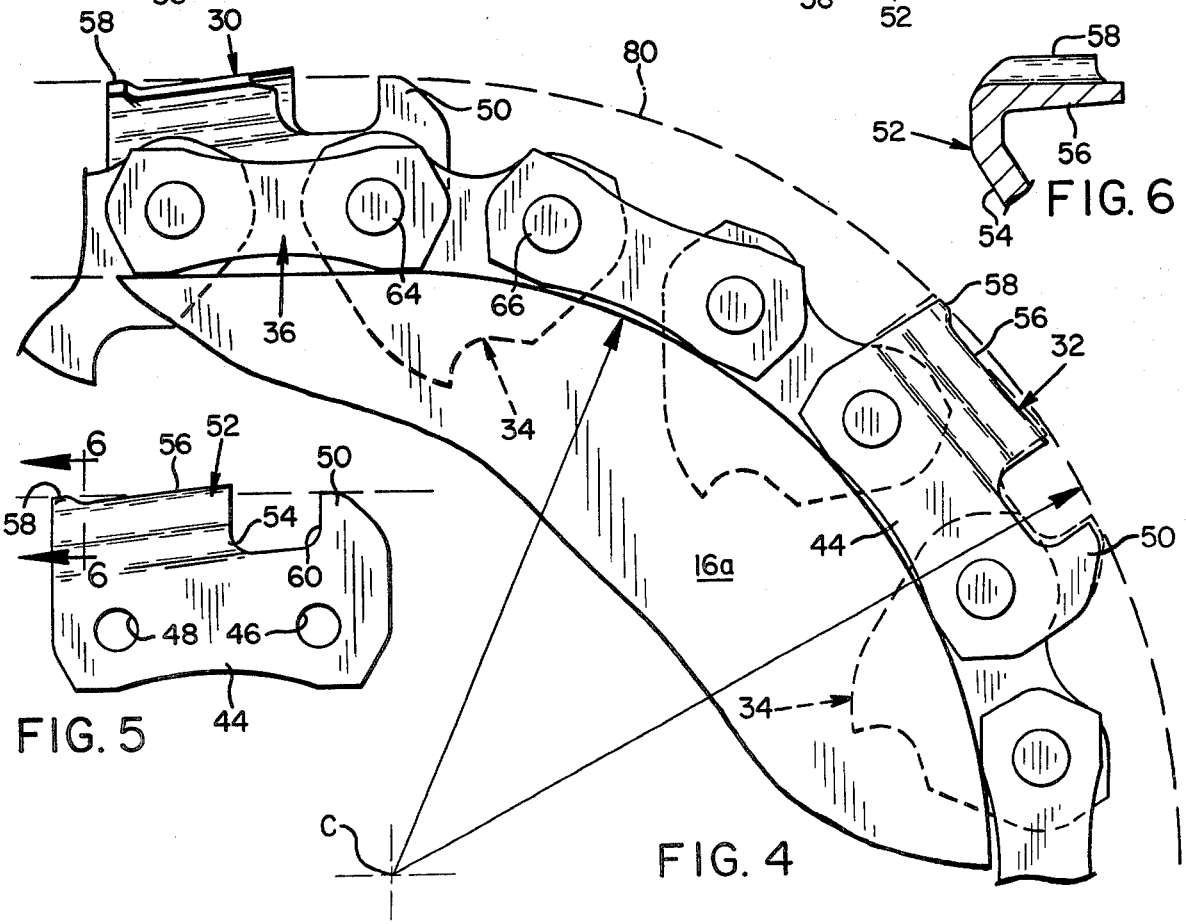
FIG. 4
FIG. 5
FIG. 6

SAW CHAIN WITH ANTI-KICKBACK CUTTER LINK

BACKGROUND AND SUMMARY

This invention relates to saw chain of the type that is used on power-driven portable chain saws. The invention more particularly concerns a saw chain of this description which exhibits when operated on a chain saw improved anti-kickback characteristics.

The usual chain saw includes a portable frame with handle, mounting a motor which powers the chain saw. Extending outwardly from the frame and motor unit is an elongate bar terminating in what is known as a nose. Saw chain trained over a power-driven sprocket in the motor and frame unit extends from such sprocket along opposite margins of the bar and around the nose of the bar. In the usual chain saw, the saw chain travels away from the operator where such extends along the top margin of the bar, and toward the operator where said extends along the bottom margin of the bar.

Chain saws of the above general description are widely used throughout the world, and generally are recognized as efficient, practical, and convenient cutting instrumentalities. However, as might be expected with any power-driven device, certain problem areas have arisen, and one which has received considerable attention with increasing concerns about safety is what is referred to as kickback when operating the chain saw under certain conditions. As generally understood today, kickback refers to the tendency of the bar in a chain saw to be thrown upwardly and rearwardly toward the operator by reason of the saw chain in the chain saw having its movement abruptly decelerated or stopped during operation of the chain saw.

A general object of this invention is to provide an improved saw chain which exhibits substantially reduced tendency to produce dangerous kickback when operated on a chain saw.

A further object is to provide such saw chain which retains the ability to cut wood efficiently and fast.

Another object is to provide a saw chain of the above general description which may be manufactured without extensive modification in many of the components in the saw chain.

Yet a further object of the invention is the provision of an anti-kickback saw chain which relies on the depth gauge of a cutter link and means located rearwardly in the cutter link from the cutting edge of the cutter portion of the link as correcting means inhibiting penetration of the cutter portion under conditions that with conventional chain would result in kickback.

These, and various other objects and advantages, are attained by the invention, which will become more fully apparent as the following description is read in conjunction with the accompanying drawings, wherein:

BRIEF DESCRIPTION OF THE DRAWINGS

FIG. 1 is a drawing illustrating, in somewhat simplified form, a chain saw including a bar with saw chain trained over the bar;

FIG. 2 illustrates, on an enlarged scale, portions of a saw chain constructed according to a preferred embodiment of the invention;

FIG. 3 is a view looking at the top of the chain;

FIG. 4 illustrates the nose portion of a chain saw bar with saw chain as contemplated herein travelling thereover;

FIG. 5 illustrates a cutter link in the saw chain; and

FIG. 6 is a cross sectional view of the cutter link, along the line 6—6 in FIG. 5.

DETAILED DESCRIPTION OF A PREFERRED EMBODIMENT

Referring now to the drawings, illustrated in FIG. 1 is a typical chain saw given the referenced numeral 10. Such includes a frame and motor unit 12, provided with handles, including handle 14, utilized by an operator in manipulating the chain saw. Extending outwardly from the frame and motor unit is an elongate bar 16. Trained over the upper and lower margins of the bar and around the nose **16*a* of the bar, is saw chain indicated generally at 18. The saw chain travels over the usual sprocket driven by frame and motor unit 10, and operation of the motor moves the chain away from the operator, or from left to right in FIG. 1**, while travelling over the top of the bar, and from right to left or toward the operator while travelling under the bar.

Nose **16*a* of the bar is rounded. That part of the nose which lies between horizontal line 20*a* extending through the extreme end of the nose, and vertical line 20*b*** which innersects the bar approximately at the transition from straight to curved portions in the bar, is sometimes referred to as the upper quadrant of the nose.

Dangerous kickback is believed to occur when travel of the saw chain over the bar is rapidly stopped or curtailed by portions of the saw chain engaging an obstruction when located on the above-indicated upper quadrant of the nose of the bar. When this occurs, and assuming that the chain at region x is prevented from moving, a reaction force is produced which throws the nose of the chain saw bar upwardly and to the left in FIG. 1, which is toward the location of the operator.

As will become more fully apparent hereinafter, the saw chain of the instant invention reduces or eliminates this chance for kickback to occur, by restricting or limiting the extent that the cutter portion of a cutter link may dig into the wood when travelling over the nose of the bar.

Portions of a saw chain constructed according to the invention are illustrated in FIG. 2. Referring to the drawing, saw chain 18 therein illustrated comprises a series of left and right-hand cutter links 30 and 32 distributed along the length of the chain, with left-hand cutter links alternating with right-hand cutter links progressing along the length of the chain. Other links, exemplified by central drive links 34 and side links or tie links 36, pivotally connected to each other and to the cutter links, complete the chain.

Describing the various links, and considering the right-hand cutter link illustrated in FIGS. 5 and 6, such includes a body portion 44. Adjacent the front end and adjacent the rear end of this body portion are rivet holes or bores 46, 48, provided for connecting the link to other links in the saw chain. Integral with the body portion and projecting upwardly from the body portion adjacent its forward end is a depth gauge 50. The top of the depth gauge extends forwardly in the link from approximately the center of forward rivet hole 46.

Cutter portion 52 of the cutter link comprises a shank 54 joined with the body portion and projecting upwardly therefrom. Such in the usual instance curves outwardly somewhat progressing upwardly from the body portion, and then extends further upwardly in the link. The top of the cutter portion is formed by a toe 56 joined with the shank and positioned laterally of the shank whereby it overlies the body portion. The toe may meet with the shank in a relatively sharp angle, in what is known as a chisel-type cutter, or the joinder may be over a rounded portion in what is commonly known as a chipper-type cutter.

Toe 56 has an upper or outer surface which inclines downwardly toward the body portion of the link progressing rearwardly from the front end of the cutter portion. The cutter portion ordinarily is sharpened along the front end thereof, both along the front of the toe and the front of the shank, to produce a cutting edge which cuts into the wood during operation of the saw chain. The slope of the upper surface of toe 56 provides proper clearance whereby the cutter portion may dig into the wood.

Formed at the rear end of toe 56 is what is referred to as a shoulder 58. The shoulder extends upwardly from the body portion of the link a greater distance than the top surface of toe 56 immediately in front of the shoulder. However, the height of the shoulder is not as great as the height of the cutter portion where such is sharpened. Shoulder 58 is located rearwardly in the link from the center of rear rivet hole 48.

Depth gauge 50 has a height which is somewhat less than the height of the cutting edge at the forward end of the cutter portion. In the case of the cutter link shown in FIG. 5, the depth gauge has substantially the height of shoulder 58. With the depth gauge having a height which is less than the cutter portion, the necessary clearance is provided whereby, when the cutter link moves through wood and while moving in a straight path, the cutter portion will dig into the wood to a controlled extent. As is usual with saw chain, the depth gauge is separated from the cutter portion by a gullet shown at 60.

A left-hand cutter link resembles a right-hand cutter link, but differs in that it is an allochirol counterpart mounted on the opposite side of the chain.

Considering the remaining links in the saw chain, which may be conventional, drive link 34 includes a body portion and a downwardly projecting extension 35 which innerfits with the motor-driven sprocket of the chain saw. Side links 36 have bottom contours essentially corresponding to the bottom contours of the cutter links, and are substantially symmetrical, in that their upper contours substantially correspond to their bottom contours.

The side links and the drive links, like the cutter links, are provided with holes or bores adjacent forward and rear ends for receiving the rivets which innerconnect the links in the chain, in the same manner as the cutter links described.

In the assembled chain shown in FIG. 2, a side link and left-hand cutter link 30 are secured, by rivet 64, on either side of and to the rear end of a center drive link which precedes the cutter link. A pair of side links, in turn, are secured, by rivet 66, on either side of and to the forward end of the drive link. These side links in turn straddle, and are connected, by a rivet, to the rear end of another center drive link. Cutter link 32 and a side link, in turn, are connected by a rivet to the forward end of this other drive link. Although not shown, it should be understood that this construction is repeated extending along the length of the chain, with other drive links being pivotally innerconnected to the forward end of cutter link 32 which are then joined to yet another cutter link 30. In describing a specific chain construction, it should be understood that saw chains may differ with respect to details of construction, such as the frequency with which cutter links appear along the length of the chain, configurations selected for respective links, and whether or not so-called bumper or fender links are provided in advance of a cutter link.

FIG. 4 illustrates portions of a saw chain constructed as above-described travelling around the nose of a bar in a chain saw. The nose of the bar curves over an arc with such arc having a center of curvature indicated in FIG. 4 at C.

The arc indicated at 80 in FIG. 4 defines the path of the outer surface of shoulder 58 in a cutter link on such moving around the bar nose. Such arc passes over the top of the cutter portion in the cutter link, and over the top of the depth gauge. (The top of the shoulder and the top of the depth gauge were earlier explained in the specific embodiment of the invention shown as having substantially equal heights, but because the shoulder is located more rearwardly in the link from the center of the rear rivet hole than the depth gauge is located forwardly from the center of the forward rivet hole, the depth gauge travels in an arc which is slightly below the arc of the shoulder.) In the event that the shoulder engages wood on traveling around the bar nose, this has the effect of tending to raise the forward end of the cutter link, displacing the depth gauge outwardly somewhat on the bar nose. It should be understood that any saw chain mounted on a chain saw bar is never absolutely tight, which permits this normal type of movement to occur. With such movement occurring, the cutter link assumes the position shown in dot-dash-dot line in FIG. 4. With the depth gauge and shoulder moving in a common path, which is the line of the saw kerf were the saw chain cutting wood, the cutting edge of the cutter is maintained below the line of the kerf.

The construction of the invention, in a manner of speaking, is effective to limit the clearance provided the cutting edge of the cutter portion with respect to a concavely curved surface engaging the depth gauge and shoulder. The result of the construction is to limit the extent that the cutting edge of the cutter portion may penetrate the wood when traveling over the nose of the bar. This has a direct affect in minimizing chance of dangerous kickback during operation of a chain saw equipped with the saw chain of the invention. While limiting the clearance of the cutting edge of the cutter portion with respect to such concavely curved surface, the shoulder has minimal, if any, effect with respect to the clearance provided the cutting edge with a cutter moving along a straight path, as occurs when the cutter is moving along the so-called flat of a bar where normal cutting is performed.

The construction contemplated does not require extensive modification of manufacturing procedures used in making the chain. The various links in the chain may be similar to conventional links, same for the cutter link and the manufacture of this link is changed primarily only with respect to the manner in which the rear end of the cutter portion is formed.

While an embodiment of the invention has been shown and described, it is appreciated that various modifications and variations would be apparent to one skilled in the art.

It is claimed and desired to secure by Letters Patent:

1. In combination with a chain saw which includes a bar, the bar terminating in a nose with a curved profile and the upper quadrant of such nose curving about a center of curvature located inwardly from the end of the nose and between top and bottom margins of the bar, a saw chain mounted on said bar guided for movement along top and bottom margins of the bar and over the nose, said saw chain having left and right-hand cutter links distributed along the length thereof and said cutter links being side links in the chain, said chain further having other links completing the chain, said other links including an opposing side link opposite each cutter link and forward and rear center links partially overlapping forward and rear portions of the cutter link and its opposing side link, means pivotally connecting the links together in the chain including a forward rivet connecting the cutter link and its opposing side link to a forward center link and a rear rivet connecting the cutter link and its opposing side link to a rear center link, each cutter link including a body portion and an elongate cutter portion joined to and projecting outwardly from the body portion and extending along the length of the cutter link, the cutter portion of the cutter link at the forward end thereof being sharpened for cutting purposes and said forward end being located no farther forwardly than the rear of the forward center link, the cutter portion having an outer surface which inclines downwardly toward the body portion of the link progressing rearwardly from the forward end thereof and further having a shoulder adjacent the rear end thereof disposed outwardly from said body portion a greater distance than portions of said inclined outer surface disposed forwardly thereof, said shoulder having a top located rearwardly in the chain from the rear of the rear rivet, said cutter link further including a depth gauge joined to the body portion spaced forwardly of said cutter portion and projecting outwardly from the body portion of the cutter link, said depth gauge having a top located above a forward rivet in a region disposed between front and rear sides of the forward rivet, said cutter link when positioned on said upper quadrant of said nose being positionable to place the top of said shoulder and the top of said depth gauge with such lying in an arc centered at the center of curvature of said upper quadrant, said arc with the cutter link so positioned extending above the top of the cutting edge in the cutter portion.

2. In saw chain having left and right-hand cutter links distributed along the length of the chain, said links being side links with the left hand cutter links being on one side and the right hand cutter links being on the other side of the chain, other links completing the chain including for each cutter link an opposing side link opposite each cutter link, a leading center link leading the cutter link with a rear portion thereof disposed between a forward portion of each cutter link and its opposing side link, and a trailing center link trailing the cutter link with a forward portion thereof disposed between a rear portion of the cutter link and its opposing side link, means pivotally interconnecting the links in the chain including for each cutter link a forward rivet pivotally connecting the forward portion of the cutter link and its opposing side link with the rear portion of a leading center link disposed therebetween and a rear rivet pivotally interconnecting the rear portion of the cutter link and its opposing side link with the forward portion of a trailing center link disposed therebetween, each cutter link including a body portion, a depth gauge portion joined to and projecting upwardly from the body portion at the forward end of the link with the top of said depth gauge located above a forward rivet in a region disposed between front and rear sides of the rivet, and a cutter portion joined to and projecting upwardly from the body portion spaced rearwardly of the depth gauge, said cutter portion having a sharpened forward end located no further forwardly than the rear of the leading center link and upper outer surface which inclines downwardly toward the body portion of the link progressing rearwardly of said forward end, said cutter portion further having a shoulder adjacent the rear end thereof having a top disposed upwardly from said body portion a greater distance than portions of said inclined outer surface disposed forwardly of said shoulder, said top being located rearwardly in the chain from the rear of the rear rivet, said top of said shoulder and said top of said depth gauge serving to fend off a surface facing the cutter link from the sharpened end of the cutter portion with the cutter link traveling over the rounded end of the nose of a saw bar.

3. The saw chain of claim 2, wherein the cutter portion includes a shank joining with the body portion and extending upwardly therefrom and an elongate toe positioned to one side of and joined with the shank forming the outer extremity of the cutter portion, said toe having an outer surface which is the outer surface of the cutter portion, said toe being formed with said shoulder, said top of said shoulder and said top of said depth gauge being substantially at the same elevation above said body portion.

* * * * *